US010442235B2

(12) United States Patent
Gamage

(10) Patent No.: US 10,442,235 B2
(45) Date of Patent: Oct. 15, 2019

(54) SYSTEM AND METHOD FOR ENTERTAINMENT DEVICES EMPLOYING ANIMATRONICS

(71) Applicant: Menuka Gamage, Los Angeles, CA (US)

(72) Inventor: Menuka Gamage, Los Angeles, CA (US)

( * ) Notice: Subject to any disclaimer, the term of this patent is extended or adjusted under 35 U.S.C. 154(b) by 0 days.

(21) Appl. No.: 16/276,562

(22) Filed: Feb. 14, 2019

(65) Prior Publication Data

US 2019/0248170 A1 Aug. 15, 2019

Related U.S. Application Data

(60) Provisional application No. 62/630,648, filed on Feb. 14, 2018.

(51) Int. Cl.
*A63H 33/38* (2006.01)
*B42D 15/02* (2006.01)
*B42D 15/04* (2006.01)

(52) U.S. Cl.
CPC ..... *B42D 15/022* (2013.01); *B42D 15/027* (2013.01); *B42D 15/042* (2013.01)

(58) Field of Classification Search
CPC .. A63H 33/38; G09F 1/04; G09F 1/06; G09F 1/08; G09F 2001/085
See application file for complete search history.

(56) References Cited

U.S. PATENT DOCUMENTS 5,139,454 A * 8/1992 Earnest ..... B42D 15/045 40/124.12
5,748,082 A * 5/1998 Payne ..... B42D 15/022 340/384.6
2004/0077260 A1* 4/2004 Wong ..... A63H 3/18 446/150
2008/0078108 A1* 4/2008 Caster ..... B42D 15/042 40/124.01
2008/0313941 A1* 12/2008 Kelly ..... G09F 1/04 40/411
2012/0170129 A1* 7/2012 Balian ..... G02B 27/2214 359/626
2016/0265089 A1* 9/2016 Schuh ..... C22C 9/01

* cited by examiner

*Primary Examiner* — Gary C Hoge
(74) *Attorney, Agent, or Firm* — Jafari Law Group, Inc.

(57) ABSTRACT

The invention relates to animatronics on entertainment devices such as greeting cards. A shape memory-alloy wire may be coupled to a PCB housed within a greeting card body. The wire may be anchored to a linkage assembly that is swivably, rotably, pivotably, extendably or otherwise movably coupled to the greeting card body. The PCB may be configured to generate a signal to a driving circuit for supplying an electrical current through the wire, the current having a variable amperage that is modified based on the pulse file. The variable amperage causes a change in the temperature of the wire, which causes the wire, and thus the linkage assembly, to contract and expand. The linkage assembly may be coupled to a display body, which may include an animal shape, characters, popular culture images and the like. Movement of the linkage assembly causes the display body to move in an entertaining manner.

18 Claims, 10 Drawing Sheets

SYSTEM AND METHOD FOR ENTERTAINMENT DEVICES EMPLOYING ANIMATRONICS

PRIORITY NOTICE

The present application claims priority under 35 U.S.C. § 119(e) to U.S. Provisional Patent Application Ser. No. 62/630,648 filed on Feb. 14, 2018, the disclosure of which is incorporated herein by reference in its entirety.

TECHNICAL FIELD OF THE INVENTION

The present disclosure relates generally to a system and method for entertainment devices that employ animatronics. More specifically, the present disclosure relates to a system and method for implementing animatronics in animated entertainment devices such as greeting cards, board games and or animated wall mounts.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever. Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Greeting cards implementing moving parts have been around for many years. In fact, the prior art is riddled with disclosures discussing variations of these entertainment devices. Some greeting cards include cut-outs that pop out when the card is opened. Other greeting cards further include multimedia elements such as sound effects produced by a speaker or an optical illusion that makes the card appear to have motion. Yet other similar devices, include cardboard displays that use lights or motors to grab a consumer's attention.

The prior art has many shortcomings. One problem with greeting cards employing moving components, is that conventional motors are limited in motion. Typically, this limitation is due to the challenges of employing motors in a greeting card body that is desirably flat. Often, several gears and additional moving parts must be coupled to the motor in order to achieve a particular motion; this of course makes it difficult to employ flat or planar card bodies. Although several types of actuators have been disclosed in the prior art, one problem with conventional actuators for greeting cards are that fine motor control is difficult to achieve with the less expensive motors required to make mass production financially feasible. Yet another problem with conventional actuators, is achieving a desirable synchronization of motion to accompanying sound that is also often desirable in these entertainment devices. Yet another problem with existing products is the battery life required by conventional motors, which leaves manufacturers of these entertainment devices with the choice between poor battery lifespan or a heavier clunkier greeting card.

Accordingly, there is an unanticipated or inadequately addressed need for an improved actuator that facilitates animatronics on entertainment devices, including greeting cards. There is a need for an improved system of employing these actuators with media such as audio or lights, in a manner that more precisely synchronizes movement with lights or sound. Further, there is a need to employ an improved system that achieves efficient and prolong battery life. Moreover, it is desirable to achieve all these benefits and more without increasing costs of manufacture.

Therefore, there is a need for a system and method of employing animatronics on entertainment devices, which address the above-mentioned concerns. It is to these ends that the present invention has been developed.

SUMMARY OF THE INVENTION

To minimize the limitations in the prior art, and to minimize other limitations that will be apparent upon reading and understanding the present specification, the present invention describes a system and method for animatronics with animated entertainment devices such as greeting cards, board games and or animated wall mounts.

Generally, the invention involves implementation of animatronics on entertainment devices. In accordance with the present invention, an electrically bendable shape memory-alloy wire may be coupled to a printed circuit board (PCB) housed within a frame of an entertainment device, such as within or on a greeting card body. The memory-alloy wire may be anchored or attached to a linkage assembly that is swivably, rotably, pivotably or otherwise movably coupled to the greeting card body. A microcontroller, in communication with the PCB, may be programmed with a set of executable instructions configured to generate an electrical charge with a variable amperage that is modified based on a pulse file. The pulse file may be stored in the memory and may have been previously synchronized with an audio file. In some embodiments, the pulse file may be generated from an audio file or some other media file in order to synchronize the pulse file with the audio file. In other embodiments, no audio file or audio output is involved and merely a pulse file is utilized. In either embodiment, the microcontroller causes the linkage assembly to move by causing the memory-alloy wire to contract and expand in response to the electrical current; the variable amperage causing the wire to contract and expand per the pulse file. The linkage assembly may be further coupled to a foam structure or flat substrate that is configured to receive, for example via an adhesive surface, a display shape or image constructed of a lightweight, thin material. The display shape may include, without limitation, a myriad of decorative shapes such as animal shapes, character heads, butterfly wings, popular culture images and the like. Movement of the linkage assembly causes each shape to move in an entertaining manner.

An animated entertainment device in accordance with some exemplary embodiments of the present invention, may include: a greeting card body including a linkage assembly movably coupled therein; a printed circuit board (PCB) secured to the greeting card body, the PCB in communication with a microcontroller and a memory storing a pulse file; and a memory-alloy wire coupled to the PCB and attached to a mechanical fastener of the linkage assembly, wherein the microcontroller is configured to: generate a signal to a driving circuit for supplying an electrical current through the memory-alloy wire with a variable amperage that is modified based on the pulse file; and move the linkage assembly by heating the memory-alloy wire from a first temperature to a second temperature causing the memory-alloy wire to contract and expand responsive to the electrical current.

Another animated entertainment device in accordance with some exemplary embodiments of the present invention, may include: a greeting card body including a linkage assembly movably coupled therein; a printed circuit board (PCB) secured to the greeting card body, the PCB in communication with a microcontroller and a memory, the memory for storing a pulse file and an audio file, the pulse file synchronized with the audio file; a display body movably coupled to the linkage assembly and the greeting card boy; and a memory-alloy wire coupled to the PCB and attached to a mechanical fastener of the linkage assembly, wherein the microcontroller is configured to: play the audio file via a speaker coupled to the PCB; generate a signal to a driving circuit for supplying an electrical current through the memory-alloy wire with a variable amperage that is modified based on the pulse file; and move the linkage assembly by heating the memory-alloy wire from a first temperature to a second temperature causing the memory-alloy wire to contract and expand responsive to the electrical current in a manner such that the display body moves according to a beat of the audio file.

A method, performed by a microcontroller situated on a printed circuit board (PCB) secured to a greeting card body, for implementing animatronics on a greeting card in accordance with practice of some embodiments of the present invention, may include: reading a pulse file; generating an electrical current based on the pulse file; and heating a memory-alloy wire coupled to the PCB from a first temperature to a second temperature in order to contract and expand the memory-alloy wire responsive to the electrical current; wherein the memory-alloy wire is further coupled to a linkage assembly movably coupled to the greeting card body; and wherein contracting and expanding the memory-alloy wire responsive to the pulse file causes the linkage assembly to move based on the pulse file.

A method for implementing synchronized animatronics on a greeting card, in accordance with practice of some embodiments of the present invention, may include: receiving a media file; generating a signal to a driving circuit for supplying an electrical current through the memory-alloy wire with a variable amperage that is modified based on the pulse file; programming a microcontroller to generate an electrical current based on the pulse file; coupling a memory-alloy wire to a printed circuit board (PCB) secured to a greeting card body; coupling the memory-alloy wire to a linkage assembly movably coupled to the greeting card body; and connecting a switch to the PCB, the switch for closing a circuit between the microcontroller and a battery, wherein the microcontroller is configured to: generate an electrical current based on the pulse file; and move the linkage assembly by heating the memory-alloy wire from a first temperature to a second temperature causing the memory-alloy wire to contract and expand responsive to the electrical current.

It is an objective of the present invention to provide animatronic greeting cards that will overcome the shortcomings of the prior art devices.

It is another objective of the present invention to provide animatronic greeting cards for creating the novel effect of an animatronic greeting card or other animated entertainment devices.

It is another objective of the present invention to provide animatronic greeting cards that employ actuators facilitating implementation of flat greeting card bodies that may be easily delivered via mail.

It is yet another objective of the present invention to provide animatronic greeting cards that have fine motor control with low-cost components.

It is yet another objective of the present invention to provide animatronic greeting cards that are synchronized with sound.

These advantages and features of the present invention are not meant as limiting objectives, but are described herein with specificity so as to make the present invention understandable to one of ordinary skill in the art.

BRIEF DESCRIPTION OF THE DRAWINGS

The system and the method for animatronic entertainment devices as disclosed herein are further described in terms of exemplary embodiments. These exemplary embodiments are described in detail with reference to the drawings, which have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows:

FIG. 2(*b*) illustrates a flow chart of a method performed by a microcontroller on a PCB housed inside a greeting card in accordance with some exemplary embodiments of the present invention.

FIG. 2(*c*) illustrates a flow chart of a method performed by a microcontroller on a PCB housed inside a greeting card in accordance with some exemplary embodiments of the present invention.

DETAILED DESCRIPTION OF THE INVENTION

Figure 1:
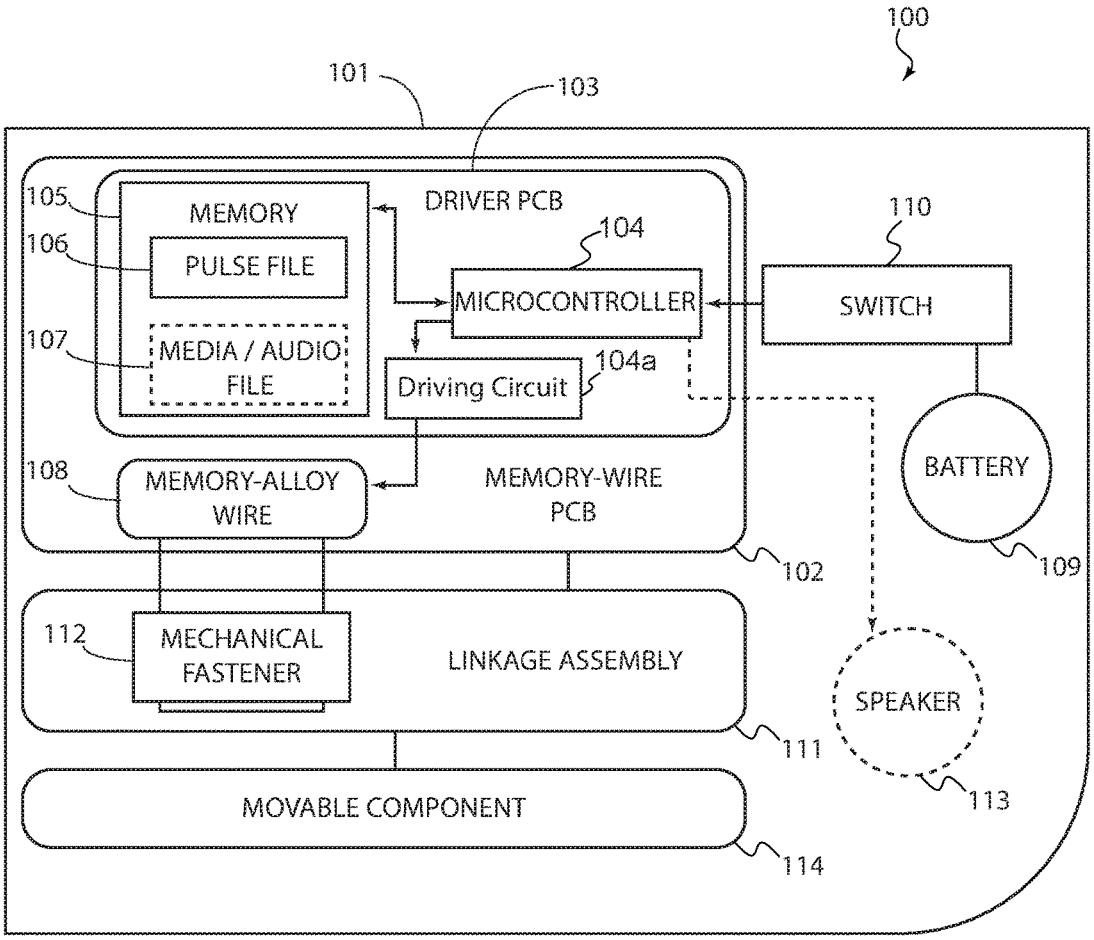
FIG. 1 illustrates a block diagram depicting an animatronic entertainment device in accordance with some exemplary embodiments of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

The present disclosure relates to, among other things, a system and method for entertainment devices that employ animatronics. Exemplary embodiments of the present disclosure are described with reference to the drawings for illustration purposes and are not intended to limit the scope of the present disclosure.

Turning now to the figures, FIG. 1 illustrates a block diagram depicting an animatronic entertainment device in accordance with some exemplary embodiments of the present invention. More specifically, FIG. 1 depicts an entertainment device 100 including a support structure or body 101, such as a greeting card body, a wall-mount body, a game-board body or any other support structure of a variety of entertainment devices that may desirably employ animatronics. Whatever the type of body 101 for which animatronics in accordance with the present disclosure are implemented, in exemplary embodiments body 101 is configured to house, enclose, or support an animatronic assembly. The unique animatronics assembly generally comprises of a memory wire printed circuit board (PCB 102) coupled to a microcontroller PCB (PCB 103) that in turn includes microcontroller 104 and memory 105. Memory 105 stores at least a pulse file 106 and in exemplary embodiments may also store a media file such as an audio file 107. A shape memory-allow wire (memory wire 108) is coupled to the microcontroller 104 via PCB 102, which is in turn in electrical communication with PCB 103. With this exemplary configuration, microcontroller 104 may be configured to generate a signal to a driving circuit 104*a* for supplying an electrical current through the memory-alloy wire with a variable amperage that is modified based on the pulse file 106, and move the linkage assembly 111 by (for example and without limiting the scope of the present invention) heating the memory-alloy wire 108 from a first temperature to a second temperature, which causes the memory-alloy wire 108 to contract and expand responsive to the variable amperage of the electrical current, as will be discussed further below.

To draw power for generating the electrical charge, microcontroller 104 may draw power from a battery 109, which is coupled to PCB 103 via a switch 110 that may be triggered whenever a user performs a desired action, including but not limited to pushing a button or performing an action such as opening a greeting card portion of or coupled to body 101.

In some exemplary embodiments, memory wire 108 may be coupled to linkage assembly 111 and more specifically anchored or attached to a mechanical fastener 112 of linkage assembly 111. Linkage assembly 111 may be in turn swivably, rotably, pivotably or otherwise movably coupled to the body 101—directly or, in some exemplary embodiments, via a movable component 114. In embodiments in which body 101 includes a greeting card body, the linkage assembly 111 may be movably coupled to the greeting card body in a manner such that opening a fold of the greeting card body triggers switch 110 thereby supplying power to PCB 105 in order to conduct an electrical charge with a variable amperage that is modified based on pulse file 106. In this way, as wire memory 108 contracts and expands, linkage assembly 111 and or moving component 114 cause a display body to move in an entertaining manner.

In some exemplary embodiments, the animatronic assembly may further include a speaker 113—for example in cases in which an audio file 107 is used to output a particular sound or any desired audio synchronized with pulse file 106. In other exemplary embodiments, no audio is implemented and thus speaker 113 may not be included. In other exemplary embodiments, a separate sound circuitry altogether may be implemented, wherein synchronization between the pulsed charge based on the pulse file and the audio output is partially achieved by a concurrent power supply simultaneously provided to both PCB 103 and the sound chip via a triggered switch 110.

Body 101 may comprise foam, plastics, cardboard, thick paper or other flat materials such as card stock. Depending on the type of entertainment device employing the animatronics in accordance with the present invention, body 101 may include a fold or multiple folds that allow a user to 'open up' the body in order to reveal the entertaining animatronic assembly housed therein. For example, and in no way limiting the scope of the present invention, body 100 may include a greeting card body with a fold that when opened reveals written or drawn information along with a movable component such as a display body shaped as a butterfly or a display body shaped as a talking head; exemplarily, such animatronic may further actuate or move automatically when opened or upon a predetermined or programmable delay. In accordance with other exemplary embodiments of the present invention, body 101 may comprise a wall mount that includes a support structure for securing linkage assembly 111 and or movable component 114. The wall mount may include levers, buttons or even doors that may be moved in order to reveal the animatronic assembly housed within or on the wall mount. In accordance with yet another exemplary embodiment, body 101 may comprise a board game body that includes a support structure for securing linkage assembly 111 and or movable component 114. The board game may be configured to activate the animatronic assembly upon a predetermined event, such as a game player activating a button, or a self-activating switch activated upon a predetermined time limit of gameplay. As may be anticipated, in either exemplary embodiment, when a user opens, unfolds or activates switch 110, the action typically closes a circuit supplying power to microcontroller 104 and causes the animatronic assembly to actuate.

PCB 102 and or PCB 103 are shown as two separate printed circuit boards however, those skilled in the art may appreciate that a single PCB may be implemented without deviating from the scope of the present invention. In exemplary embodiments, PCB 102 (and or PCB 103) may be configured for varying an amperage of the electrical charge supplied to memory wire 108 via microcontroller 104. In exemplary embodiments, PCB 102 anchors both ends of the memory wire 108 and connects the memory wire 108 to the PCB 103 (i.e. in such embodiments, PCB 102 and PCB 103 are connected with standard electrical wiring). In exemplary embodiments, PCB 103 is a driver PCB, which powers and drives the actuation of the system using a pre-programmed micro-controlled electronic circuit.

Microcontroller 104 may employ driving circuit **104*a* such as a pulse-width modulation circuit (PWM circuit) or a transistor circuitry that creates an electrical pulse modifying the amperage of the electrical charge supplied by microcontroller 104 to the memory wire 108, based on the pulse file stored in memory 105. In exemplary embodiments, the driving circuit 104*a* may be a low power NPN transistor or a field-effect transistor (FET) such as a high power MOSFET transistor. In other embodiments, the driving circuit 104*a* may be a mechanical relay or the like. The memory 105 employed by microcontroller 104** may be any type of one-time programmable memory commonly used in OTP chips.

Pulse file 106 and or audio file 107 may be relatively small files as described above. Pulse file 106 may be a pulse that is complementary to a particular audio file (such as audio file 107). Alternatively, in instances in which audio file 107 is not employed or included in entertainment device 100, pulse file may comprise a pulse having a predetermined duration or length commensurate with a desired frequency in movement effect of the linkage assembly 111.

Memory wire 108 is as mentioned above a shape memory-allow wire that changes length and or shape when PCB 103 supplies an electric current via PCB 102. The electric current causes the memory wire 108 to heat up through ohmic heating. When the memory wire 108 is thus heated, it returns to a pre-set length and/or shape—thus causing the linkage assembly 111 to move or actuate. In exemplary embodiments, memory wire 108 may comprise a Nitinol wire. Nitinol may be desirable for its "shape memory alloy" characteristics—namely the ability to be given a pre-set length and/or shape, which can be recovered consistently; the original pre-set length and/or shape is recovered simply by heating the Nitinol above its transformation temperature and after pre-setting the length and/or shape of the Nitinol, the Nitinol can be subjected to many kinds of bending, elongation, and other such changes of shape, but can always be subsequently returned to its original pre-set length and/or shape by heating the Nitinol above its transformation temperature again. As mentioned above, memory wire 108 is coupled to PCB 102 as well as to mechanical fastener 112 of linkage assembly 111. Naturally, memory wire 108 may be configured to create many different types of motion—vertically or horizontally, for example.

As may be appreciated from the various embodiments described below, one or more memory wires may be implemented without limiting the scope of the present invention. That is, it will become apparent that while frames or linkage assemblies described below may implement a single memory wire for actuation of a movable component of a frame, multiple memory wires may be employed where a frame or linkage assembly can implement multiple moving components.

Linkage assembly 111 may be one or more set of components to which the memory wire 108 applies force when it changes length and/or shape. Linkage assembly 111 actuates in an intended manner of motion when the memory wire 108 applies force to it. In exemplary embodiments, at least one component of the linkage assembly 111 may be made of a flexible, resilient material which both acts as a structural support and applies a spring force. This spring force returns the linkage assembly 111 to its original shape once the memory wire 108 ceases applying force to the linkage assembly 111. Thus, between the memory wire 108 force and the spring force, linkage assembly 111 actuates back and forth in a cyclic manner. In exemplary embodiments, at least one component of linkage assembly 111 is connected to PCB 102 using glue or some other form of structural connection. In exemplary embodiments, memory wire 108 may be connected to linkage assembly 111 by a mechanical fastener such as a rivet pin, which is press-fit into linkage assembly 111. In such embodiment, memory wire 108 loops around the rivet pin, and is compressed against linkage assembly 111 by the head of the rivet pin. Linkage assembly 111 may be also connected to components of the greeting card which move when linkage assembly 111 actuates, such as movable components 114.

Switch 110, which closes the circuit in order to activate the animatronic assembly coupled to body 101, may be a mechanical switch that activates upon a change in position. Switch 110 may also be a push button or even a light sensor. In exemplary embodiments in which body 101 comprises a greeting card body, switch 110 may be an electrical switch that is switched on or off by the opening or closing of the greeting card body.

As mentioned above, display shapes, cutouts or images on paper or other thin material may be coupled to the linkage assembly or other movable components. As will be apparent by the examples below, there are many possible configurations to produce a desired animatronic effect.

Turning now to the next figures, several methods are described. It should be noted that these methods are each shown in no particular order and that other embodiments may be practice with less steps, more steps, or the same disclosed steps in different sequence as show, without deviating from the scope of the present invention.

Figure 2A:
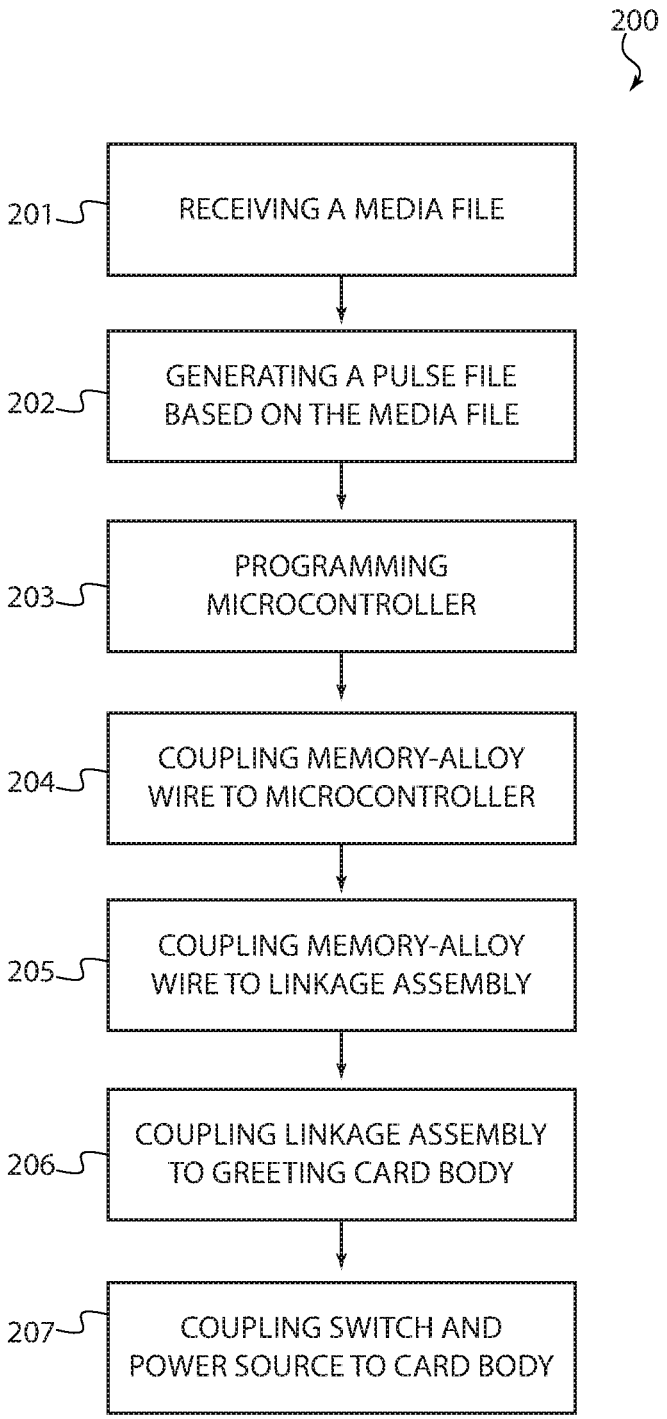
FIG. 2(*a*) illustrates a flow chart of a method for implementing animatronics on an entertainment device in accordance with practice of some exemplary embodiments of the present invention.
Figure 2B:
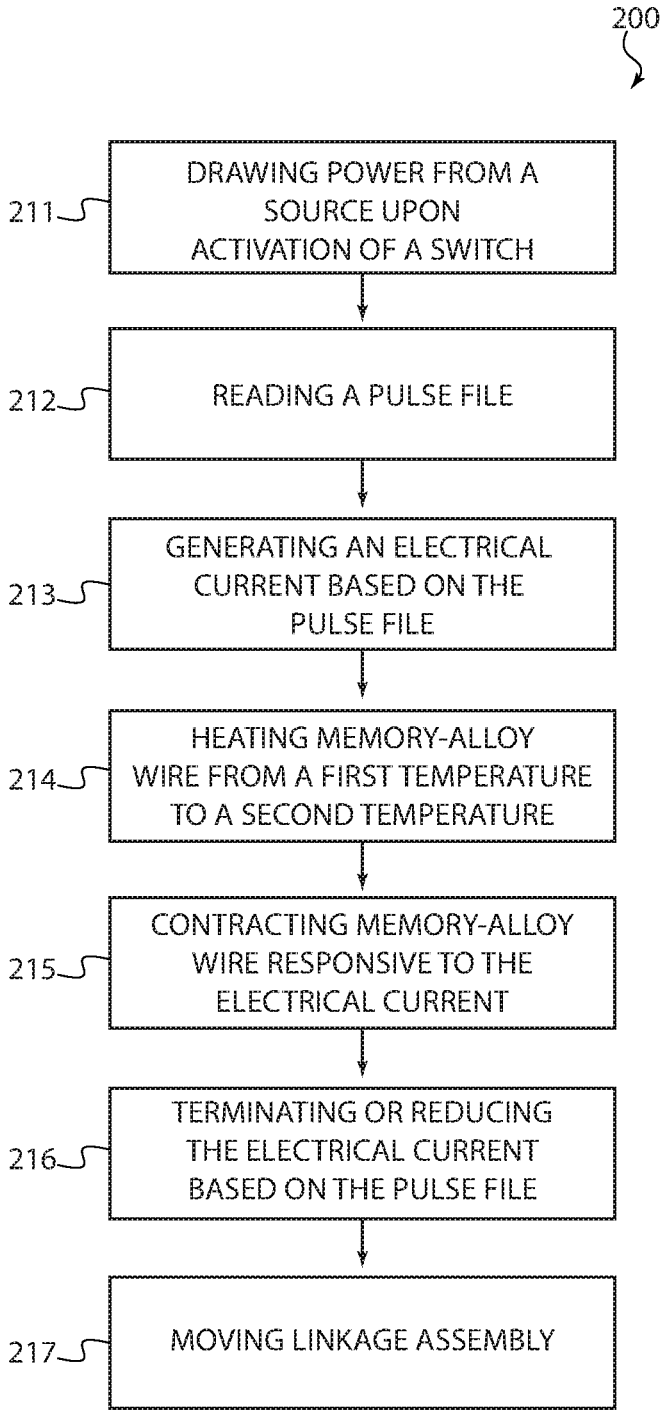
Figure 2C:
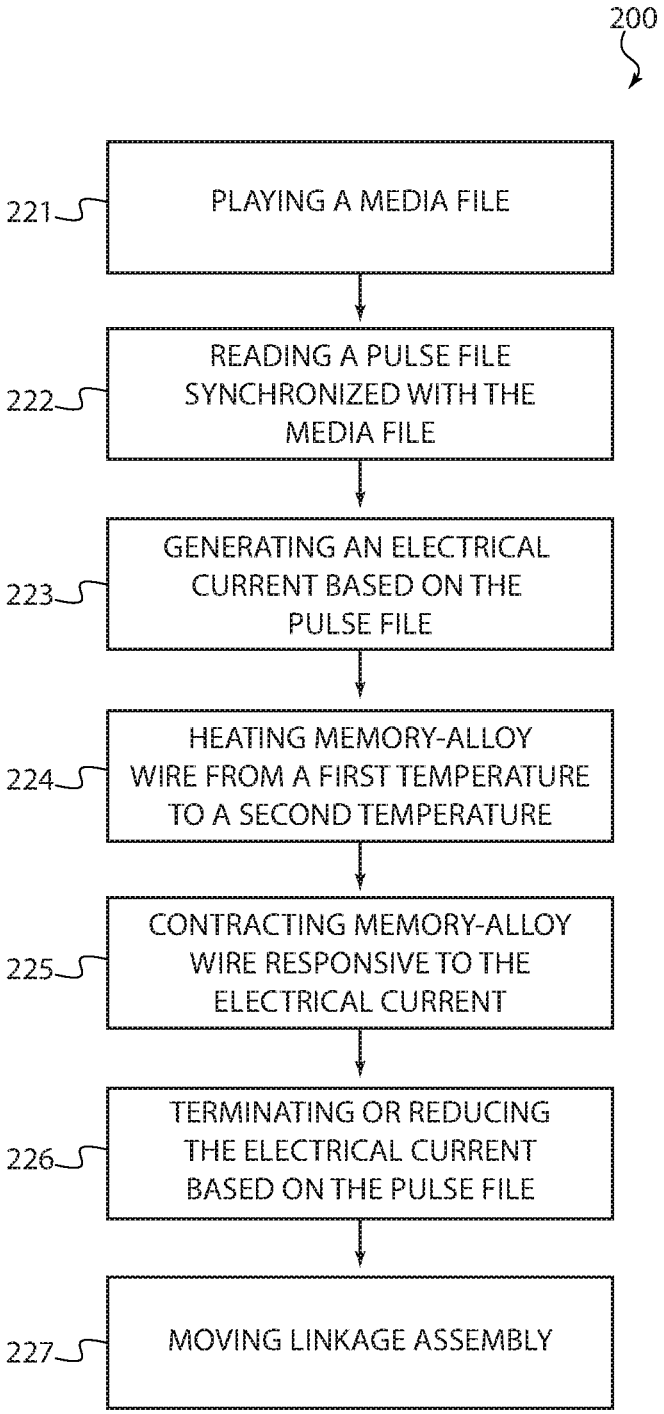

FIG. 2(*a*) illustrates a flow chart of a method for implementing animatronics on an entertainment device in accordance with practice of some exemplary embodiments of the present invention. More specifically, method 200 for implementing animatronics on a greeting card is depicted by way of a flow chart. Method 200 includes generating a pulse file based on a media file such as an audio file, so that both files may be utilized or employed by the greeting card. In such exemplary embodiments, when both files are played simultaneously, the pulse file will be synchronized with the audio file such that any movements caused by the contracting and retracting of the memory wire, will be synchronized with the audio playing concurrently therewith.

In such exemplary embodiment, a method 200 in accordance with the present invention may comprise: receiving a media file (201); generating a pulse file based on the media file (202); programming a microcontroller to generate a signal to a driving circuit for supplying an electrical current with a variable amperage that is modified based on the pulse file (203); coupling a memory wire to the microcontroller (204); coupling the memory wire to a linkage assembly (205); coupling the linkage assembly to a greeting card body (206); and coupling a switch and power source to the card body and to the microcontroller (207), the microcontroller configured to: play the audio file via a speaker coupled to the PCB, generate a signal to a driving circuit for supplying an electrical current through the memory-alloy wire with a variable amperage that is modified based on the pulse file, and move the linkage assembly by heating the memory-alloy wire from a first temperature to a second temperature causing the memory-alloy wire to contract and expand responsive to the electrical current.

In step 201, receiving a media file may include receiving an order via a website or mobile application (i.e. by way of a non-limiting example, as shown with reference to FIG. 3 below), whereby a user may select a media file from a list provided by a service provider offering an entertainment device such as a greeting card that implements animatronics in accordance with the present invention. In some embodiments, a user may actually submit to a service provider a media file of their own—for example a favorite song or audio file that the user wishes to incorporate in the animatronics-enabled entertainment device ordered from the service provider.

In step 202, generating a pulse file based on the media file may include recording a pulse file that is complementary to a particular audio on the media file. For example, and without limiting the scope of the present invention, a pulse file based on an audio on the media file may include a plurality of pulses of distinct, or similar, or identical, periodic short-duration stimuli occurring at time intervals that match a beat of the audio file selected by or for the user. Alternatively, in instances in which an audio file is not employed or included, a pulse file may comprise a pulse or a plurality of pulses of distinct, or similar, or identical, periodic short-duration stimuli occurring at time intervals that have a predetermined duration or length commensurate with a desired frequency in movement for the animatronic element to be implemented in the animatronics-enabled entertainment device.

In step 203, programming a microcontroller to generate a signal to a driving circuit for supplying an electrical current with a variable amperage that is modified based on the pulse file, may include programming any type of microcontroller such as a one-time programmable memory chip or OTP chip to modify the amperage of the electrical charge supplied by the microcontroller to the memory wire, based on the pulse file stored in the memory. In exemplary embodiments, the microcontroller may employ a transistor that can be a low power NPN transistor or a field-effect transistor (FET) such as a high power MOSFET transistor. In exemplary embodiments, programmable or executable instructions for the microcontroller may include instructions for the microcontroller to: play the audio file via a speaker coupled to the PCB (if an audio file is available), generate an electrical charge with a variable amperage that is modified based on the pulse file, and move the linkage assembly by heating the memory-alloy wire from a first temperature to a second temperature causing the memory-alloy wire to contract and expand responsive to the electrical current.

In steps 204 through 207—coupling a memory wire to a microcontroller, coupling the memory wire to a linkage assembly, coupling the linkage assembly to a greeting card body, and coupling a switch and power source to the card body and to the microcontroller may include assembling a device as described with reference to FIG. 1 above or as described below with reference to FIGS. 4(*a*)-5(*f*), without limiting the scope of the present invention, so that many arrangements and possible configurations are possible.

As mentioned above, this method may be performed without the media or audio file. That is, in exemplary embodiments, a pulse file may be generated independently of or without the reference of an audio file. In such embodiments, method 200 may comprise: generating a pulse file (202); programming a microcontroller to read the pulse file and generate a signal to a driving circuit for supplying an electrical charge with a variable amperage that is modified based on the pulse file (203); coupling a memory wire to the microcontroller (204); coupling the memory wire to a linkage assembly (205); coupling the linkage assembly to a greeting card body (206); and coupling a switch and power source to the card body and to the microcontroller (207), the microcontroller configured to: generate a signal to a driving circuit for supplying an electrical charge with a variable amperage that is modified based on the pulse file, and move the linkage assembly by heating the memory-alloy wire from a first temperature to a second temperature causing the memory-alloy wire to contract and expand responsive to the electrical current (per the pulse file).

FIG. 2(*b*) illustrates a flow chart of a method performed by a microcontroller on a PCB housed inside a greeting card in accordance with some exemplary embodiments of the present invention. More specifically, method 200, performed by a microcontroller for implementing animatronics on a greeting card, is depicted by way of a flow chart. Method 200 does not involve an audio file, and as such only a pulse file is read by the microcontroller.

In such exemplary embodiment, a method 200 in accordance with the present invention may comprise: drawing power from a power source upon activation of a switch (211); reading a pulse file (212); generating a signal to a driving circuit for supplying an electrical charge with a variable amperage that is modified based on the pulse file (213); heating a memory-alloy wire coupled to the PCB from a first temperature to a second temperature (214); contracting the memory-alloy wire responsive to the electrical current (215), including increasing or reducing an amperage of the electrical charge responsive to the pulse file (216); and causing the linkage assembly to move (227).

FIG. 2(*c*) illustrates a flow chart of a method performed by a microcontroller on a PCB housed inside a greeting card in accordance with some exemplary embodiments of the present invention. More specifically, method 200, performed by a microcontroller for implementing animatronics on a greeting card, is depicted by way of a flow chart. In this embodiment, method 200 does include playing an audio file, which has been synchronized with the pulse file that dictates the variable amperage of the electric charge.

In such embodiment, a method 200 in accordance with the present invention may comprise: playing a media file (221); reading a pulse file synchronized with the media file (222); generating a signal to a driving circuit for supplying an electrical charge with a variable amperage that is modified based on the pulse file (223); heating a memory-alloy wire coupled to the PCB from a first temperature to a second temperature (224); contracting the memory-alloy wire responsive to the electrical current (225), including increasing or reducing an amperage of the electrical charge responsive to the pulse file (226); and causing the linkage assembly to move (227).

Figure 3:
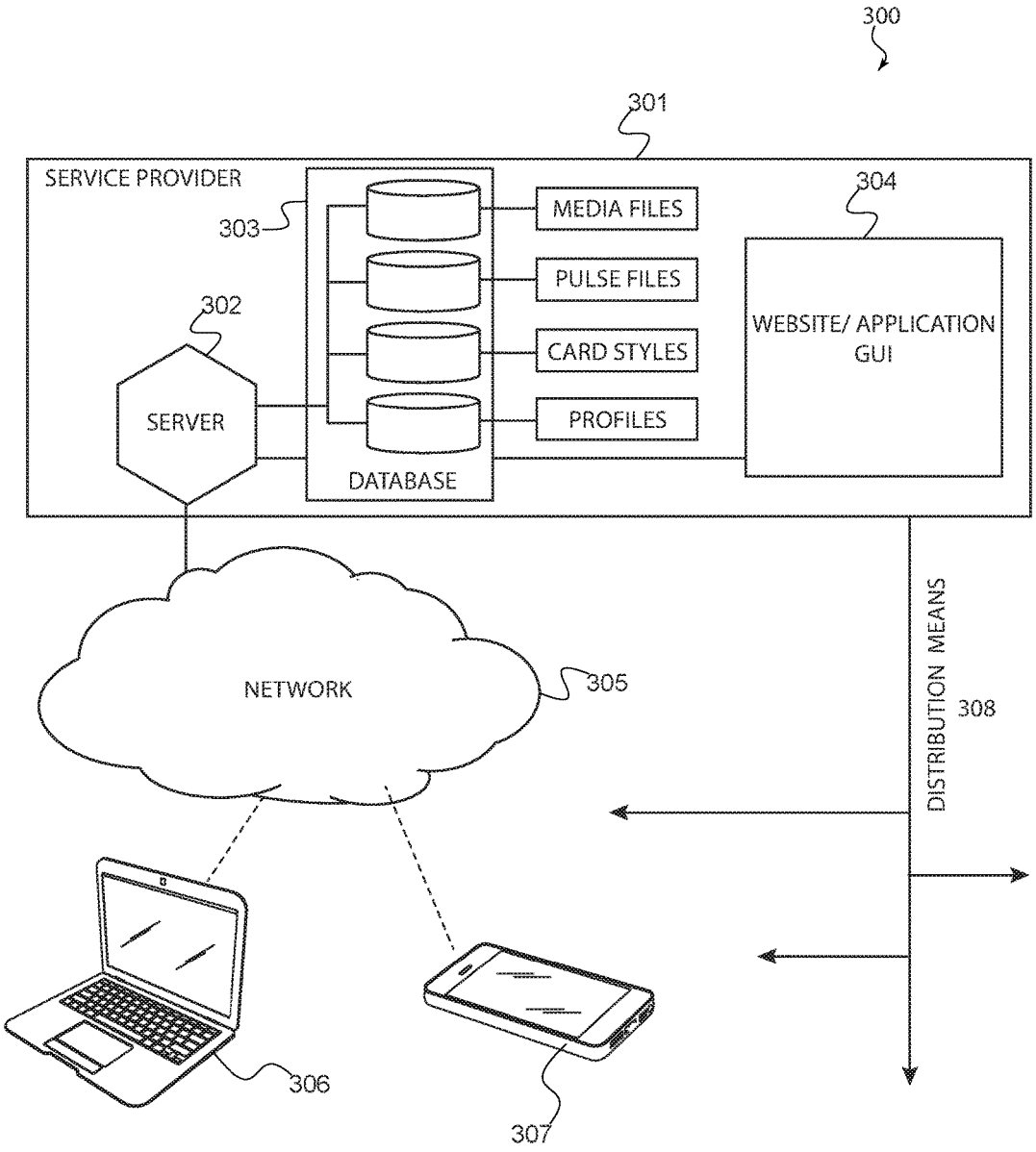
FIG. 3 illustrates a block diagram depicting a system for implementing animatronics on entertainment devices in accordance with some exemplary embodiments of the present invention.
Figure 4A:
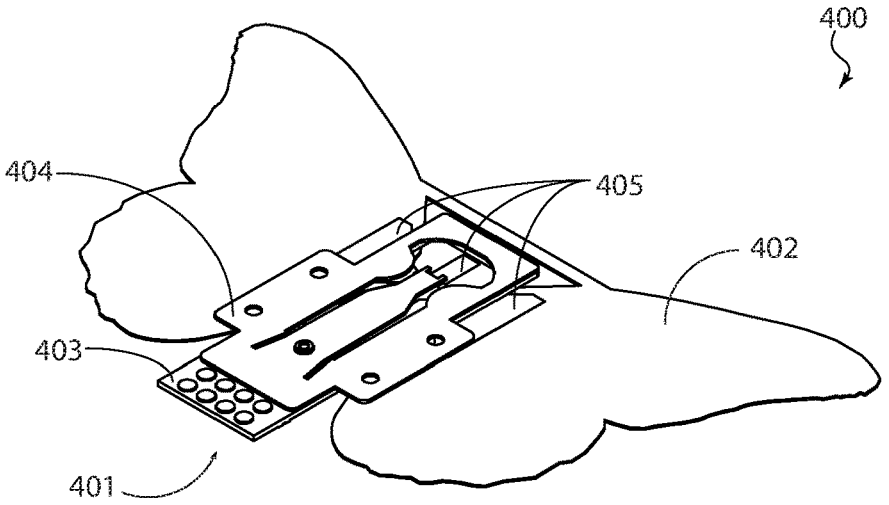
FIG. 4(*a*)-4(*f*) illustrate an animatronic assembly for a greeting card in accordance with some exemplary embodiments of the present invention.
Figure 4B:
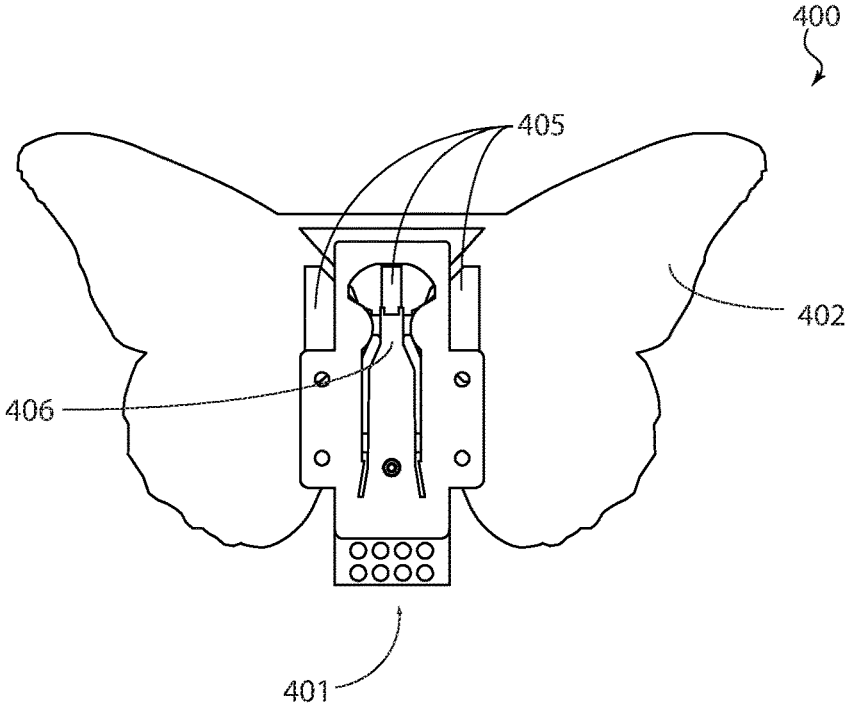
Figure 4C:
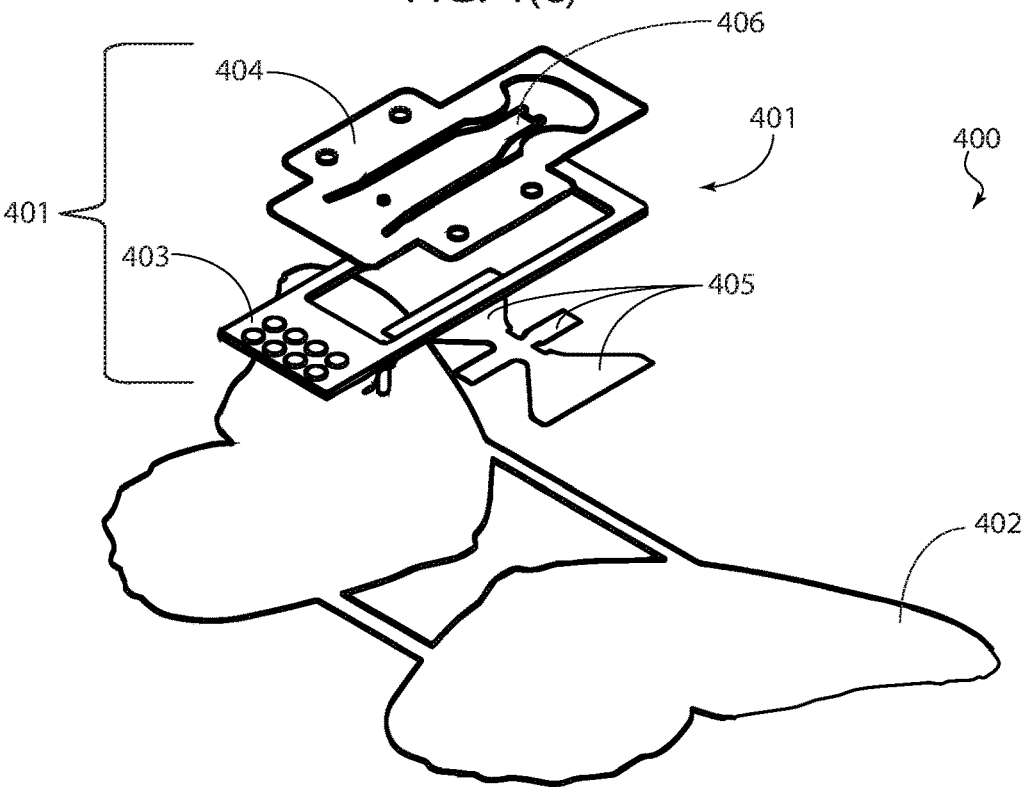
Figure 4D:
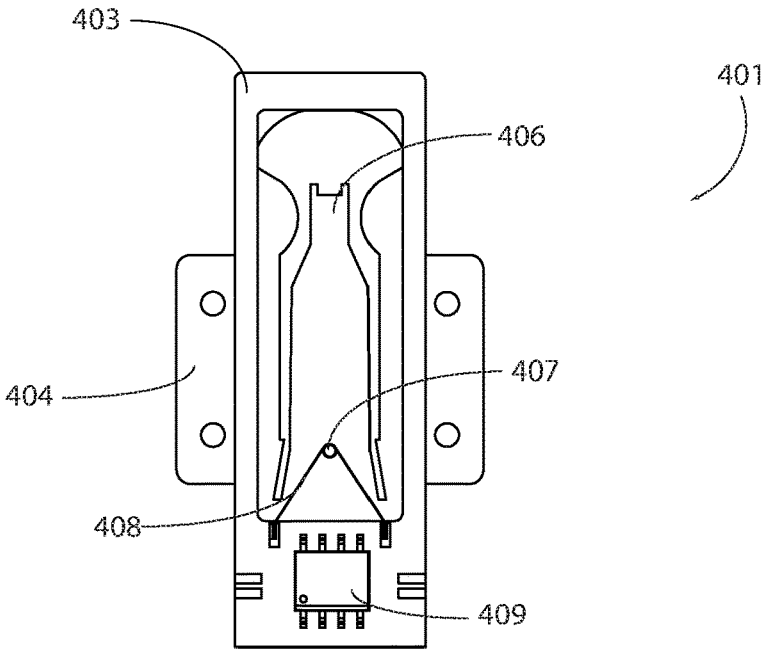
Figure 4E:
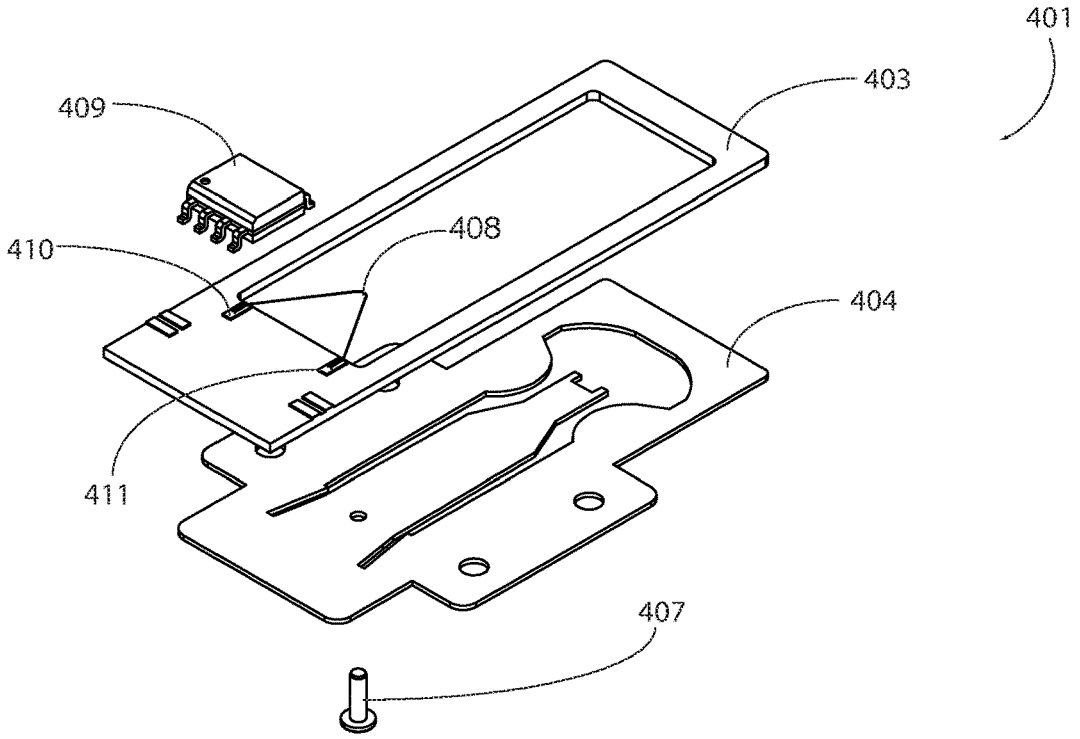
Figure 4F:
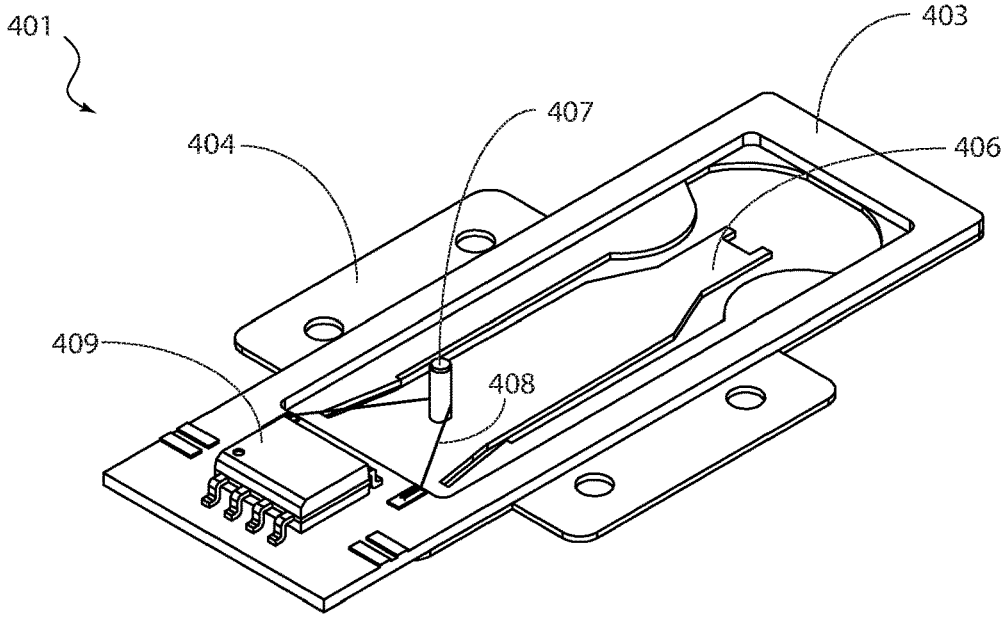
Figure 5A:
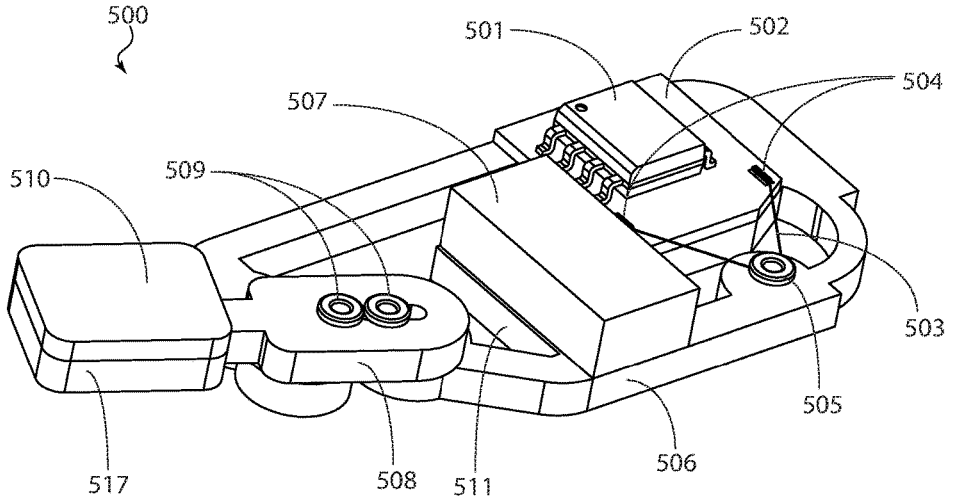
FIG. 5(*a*)-5(*f*) illustrate an animatronic assembly for a greeting card in accordance with some exemplary embodiments of the present invention.
Figure 5B:
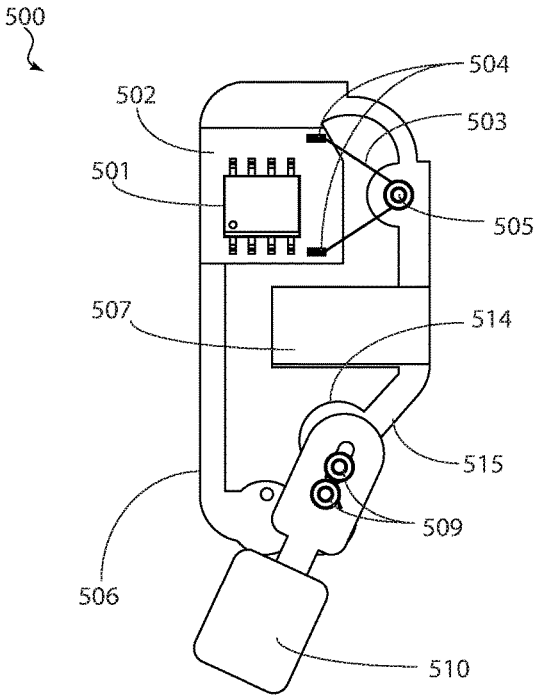
Figure 5C:
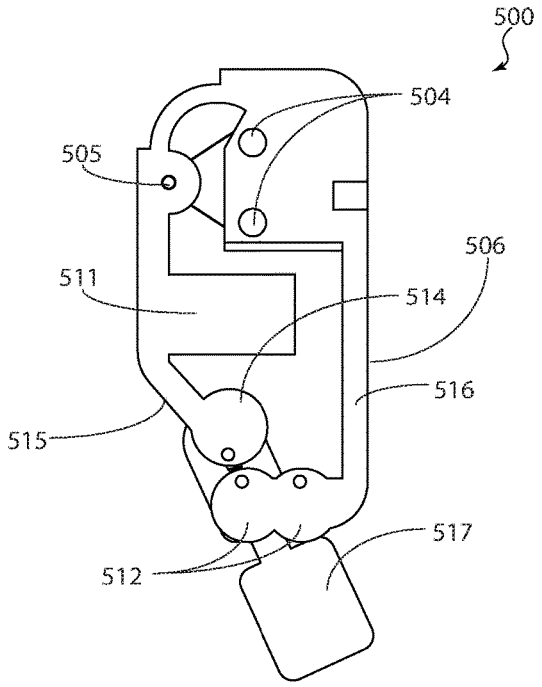
Figure 5D:
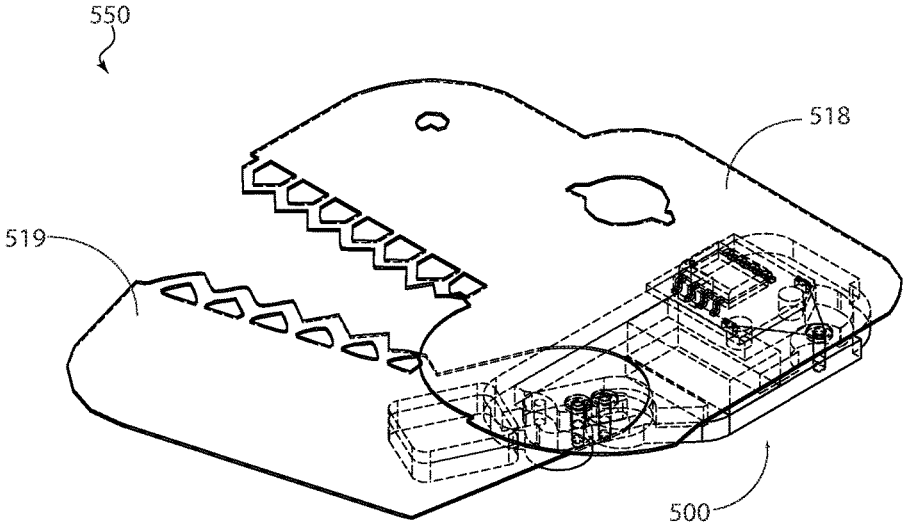
Figure 5E:
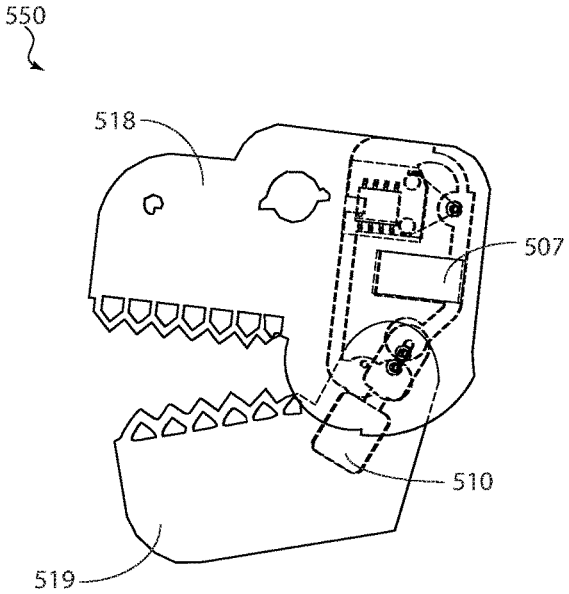
Figure 5F:
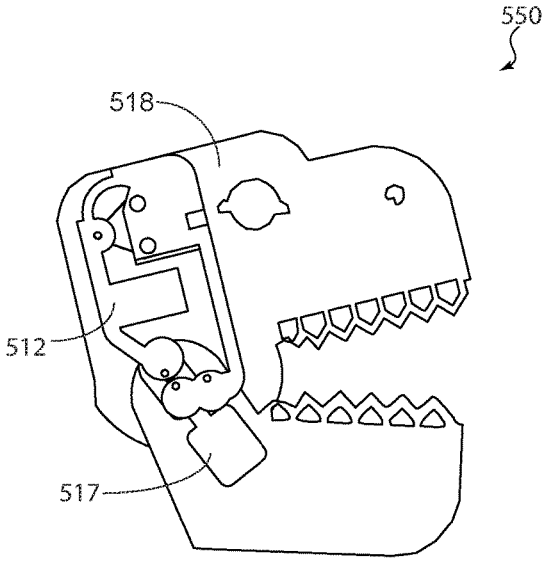

Turning now to the next figure, FIG. 3 illustrates a block diagram depicting a system for implementing animatronics on entertainment devices in accordance with some exemplary embodiments of the present invention. In such exemplary system 300, a service provider 301 may implement use of a server 302 to host a website or application for providing a graphical user interface or GUI 304 in which users may preview different animatronic assemblies and or greeting cards that may be made available to said users. In such embodiment, system 300 may include a database 303 in which different media files, such as popular songs (i.e. birthday songs) may be made available for users to select to go along with their favorite characters, icons, monsters, animals or shapes, and customize a greeting card of their choosing. Likewise, users may select from preconstructed or pre-configured greeting cards that are readily available. In exemplary embodiments, server 302 may be configured to accept orders from users via client devices 306 and 307 via a network 305 such as the Internet. Once a user chooses their greeting card or builds their own, the service provider 301 may prepare the greeting card and deliver it to the intended recipient via a delivery means 308 as is commonly implemented with items purchased on-line. Naturally, this is merely an exemplary system for providing animatronic entertainment devices in accordance with the present invention, and in no way limits the scope of this disclosure.

In some exemplary embodiments, system 300 enables a user to access GUI 304 via client device 307 and, for example, select a greeting card style from a set of selectable greeting card styles having different body types. In this example, a user may select to include, for example an audio file having a birthday tune. In this example, and without limiting the scope of the present invention, service provider 301 may have previously generated a pulse file that is synchronized with the selected audio file and thus when the user orders their greeting card, service provider 301 includes a greeting card having both the audio file and pulse file per the user selection.

Turning now to the next set of figures, FIG. 4(*a*)-4(*f*) illustrate an animatronic assembly for a greeting card in accordance with some exemplary embodiments of the present invention. This set of figures shows (respectively) a perspective view of an animatronic assembly 400; a bottom view thereof; an exploded view thereof; a top view of the animatronic assembly with a movable component such as the display body shaped like a butterfly removed; an exploded view of an actuator assembly of the animatronic assembly depicting the memory wire and PCBs; and a perspective view of the fully actuator assembly for use with the display body.

Each of the referenced components are as follows: actuator assembly 401; display body 402; memory wire PCB 403; linkage assembly 404; first movable component 405; second movable component or bendable extension 406, which extends from a center portion of the linkage assembly 404, the linkage assembly 404 having support components for securing the assembly to a greeting card body; a mechanical fastener or rivet pin 407, which may be threaded through a portion of the linkage assembly 404 and secures or anchors memory wire 408 therein; and PCB 409, which includes a programmable microcontroller for generating a signal to a driving circuit, which supplies an electrical current having a variable amperage that is modified based on the pulse file, as discussed above.

In this exemplary embodiment, the display body 402 is shaped as a butterfly. When attached to a greeting card, a switch (not shown) supplies the microcontroller on PCB 409 with power from a power source, such as a battery (not shown) also housed on the greeting card body coupled to the assembly 400. PCB 409 in turn generates the electrical charge, which as described above causes the memory wire to heat from a first temperature to a second temperature, causing the memory wire to contract and expand responsive to the electrical current, and thus responsive to the pulse file. As the memory wire contracts and expands, a force is exerted on rivet pin 407, which pulls and releases bendable extension 406 of linkage assembly 404. Because bendable extension 406 (which is shaped like a tongue disconnected from the sides of linkage assemble 404) is attached directly to movable component 405, and the display body 402 (and more specifically the wings of the butterfly) are coupled directly thereto, the wings of the butterfly move in accordance to the pulsing current.

In the exemplary embodiment disclosed with reference to FIG. 4(*a*)-FIG. 4(*f*), memory wire PCB 403 anchors both ends of the memory wire 408 and connects the memory wire 408 to the PCB 409 such that PCB 403 is a driver PCB, which powers and drives the actuation of actuator assembly 401 using the pre-programmed microcontroller of PCB 409.

Turning now to the last set of figures, FIG. 5(*a*)-5(*f*) illustrate an animatronic assembly for a greeting card in accordance with some exemplary embodiments of the present invention. This set of figures shows (respectively) a perspective view of an actuator assembly 500 for animatronic assembly 550; a top view of the actuator assembly 500; a bottom view thereof; a perspective view of animatronic assembly 550 including the actuator assembly 500 with a display body (shaped like a dinosaur head) attached and ready for use with a suitable entertainment device including a greeting card; a top view thereof; and a bottom view thereof showing how each component of the display body is attached to different portions of the actuator assembly 500.

Each of the referenced components are as follows: actuator assembly 500; microcontroller PCB including a microcontroller (PCB 501) for generating an electrical charge with a variable amperage that is modified based on a pulse file, as discussed above; memory wire PCB 502; memory wire 503; memory wire connections 504 (to PCB 502); a mechanical fastener (or rivet pin 505); linkage assembly (or frame) 506; foam structure 507 that may include an adhesive for receiving a portion of the display body; a movable component or linkage arm 508, swivably coupled to the linkage assembly 506 via joints 509; a second foam structure 510, which may also include an adhesive for receiving a portion of the display body; support structure 511 for supporting foam structure 507 which in turn supports the display body; joint supports 512 and 514 for supporting joints 509; frame arms 515, 516; support structure 517 for supporting foam structure 510, which may similarly include an adhesive for receiving a portion of the display body; and display components 518 and 519 that make up the display body—in the exemplary case, a dinosaur head.

In this exemplary embodiment, the display body comprising display components 518 and 519 is shaped as a dinosaur head. When attached to a greeting card, a switch (not shown) supplies PCB 501 via PCB 502 with power from a power source, such as a battery (not shown) also housed on the greeting card body coupled to the animatronic assembly 550. Microcontroller 501 in turn generates the electrical charge, which as described above causes the memory wire to heat from a first temperature to a second temperature, causing the memory wire to contract and expand responsive to the electrical current, and thus responsive to the pulse file. As the memory wire contracts and expands, a force is exerted on rivet pin 505, which pulls and releases the frame or linkage assembly 506. Because linkage assembly 506 is attached directly to linkage arm 508, and the various components therein move along with the movement of the contracting and expanding wire 503, the display body (and more specifically the jaw or bottom portion of the display body (display component 519) moves in accordance to the pulsing current.

The foregoing detailed description has set forth various embodiments of the devices and/or processes by the use of diagrams, flowcharts, and/or examples. Insofar as such diagrams, flowcharts, and/or examples contain one or more functions and/or operations, it will be understood by those within the art that each function and/or operation within such diagrams, flowcharts, or examples may be implemented, individually and/or collectively, by a wide range of hardware, software, firmware, or virtually any combination thereof.

Those skilled in the art will recognize that it is common within the art to describe devices and/or processes in the fashion set forth herein, and thereafter use engineering practices to integrate such described devices and/or processes into other similar systems. That is, at least a part of the devices and/or processes described herein may be integrated into a greeting card or greeting card generation system via a reasonable amount of experimentation.

The subject matter described herein sometimes illustrates different components contained within, or connected with, other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

A system and method for entertainment devices that employ animatronics has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. An animated entertainment device, comprising:
- a greeting card body including a linkage assembly movably coupled therein;
- a printed circuit board (PCB) secured to the greeting card body, the PCB in communication with a microcontroller and a memory storing a pulse file; and
- a memory-alloy wire coupled to the PCB and attached to a mechanical fastener of the linkage assembly, wherein the microcontroller is configured to:
  - generate a signal to a driving circuit for supplying an electrical current through the memory-alloy wire with a variable amperage that is modified based on the pulse file; and
  - move the linkage assembly by heating the memory-alloy wire from a first temperature to a second temperature causing the memory-alloy wire to contract and expand responsive to the electrical current.

2. The animated entertainment device of claim 1, wherein the driving circuit comprises a MOSFET transistor.

3. The animated entertainment device of claim 1, wherein:
- the PCB anchors terminal ends of the memory-alloy wire; and
- connects the memory-alloy wire to a driver PCB in communication with the PCB, the driver PCB including the microcontroller.

4. The animated entertainment device of claim 1, further comprising a display body coupled to the linkage assembly in a manner configured to move the display body responsive to the electrical current having the variable amperage that is modified based on the pulse file.

5. The animated entertainment device of claim 1, wherein the memory further comprises an audio file.

6. The animated entertainment device of claim 5, wherein the audio file is synchronized with the pulse file.

7. The animated entertainment device of claim 1, further comprising a switch coupled to the greeting card body and a battery, the switch for closing a circuit between the microcontroller and the battery in order to trigger activation of the microcontroller.

8. The animated entertainment device of claim 1, wherein the microcontroller is further configured to generate the electrical current after a programmable delay.

9. The animated entertainment device of claim 1, wherein mechanical fastener of the linkage assembly comprises a rivet pin.

10. The animated entertainment device of claim 1, wherein the linkage assembly is configured to swing, rotate, pivot or extend to move a display body coupled to the linkage assembly.

11. The animated entertainment device of claim 1, wherein the display body comprises a butterfly shape.

12. The animated entertainment device of claim 1, wherein the display body comprises a dinosaur head.

13. The animated entertainment device of claim 1, wherein the microcontroller is a one-time programmable memory chip.

14. An animated entertainment device, comprising:

a greeting card body including a linkage assembly movably coupled therein;

a printed circuit board (PCB) secured to the greeting card body, the PCB in communication with a microcontroller and a memory, the memory for storing a pulse file and an audio file, the pulse file synchronized with the audio file;

a display body movably coupled to the linkage assembly and the greeting card boy; and a memory-alloy wire coupled to the PCB and attached to a mechanical fastener of the linkage assembly, wherein the microcontroller is configured to:

play the audio file via a speaker coupled to the PCB;

generate a signal to a driving circuit for supplying an electrical current through the memory-alloy wire with a variable amperage that is modified based on the pulse file; and move the linkage assembly by heating the memory-alloy wire from a first temperature to a second temperature causing the memory-alloy wire to contract and expand responsive to the electrical current in a manner such that the display body moves according to a beat of the audio file.

15. The animated entertainment device of claim 14, wherein:

the PCB anchors terminal ends of the memory-alloy wire; and connects the memory-alloy wire to a driver PCB in communication with the PCB, the driver PCB including the microcontroller.

16. The animated entertainment device of claim 14, wherein the driving circuit comprises a MOSFET transistor.

17. The animated entertainment device of claim 14, wherein the linkage assembly is configured to swing, rotate, pivot or extend to move the display body.

18. The animated entertainment device of claim 14, further comprising a switch coupled to the greeting card body and a battery, the switch for closing a circuit between the microcontroller and the battery in order to trigger activation of the microcontroller.

* * * * *